United States Patent [19]

McGlinn

[11] Patent Number: 4,596,530

[45] Date of Patent: Jun. 24, 1986

[54] RESCUE DEVICE

[76] Inventor: Thomas B. McGlinn, c/o Rhumb Line Limited, Fleming Street, Roadtown, Tortola, British Virgin Isls.

[21] Appl. No.: 679,537

[22] Filed: Dec. 7, 1984

[30] Foreign Application Priority Data

Dec. 8, 1983 [GB] United Kingdom ..... 8332802

[51] Int. Cl.[4] ..... B63C 9/00

[52] U.S. Cl. ..... 441/80; 119/153; 294/19.1; 441/84

[58] Field of Search ..... 119/151, 153; 441/80, 441/84; 114/221 R; 294/19.1

[56] References Cited

U.S. PATENT DOCUMENTS

| | | | |
|---|---|---|---|
| 1,759,054 | 5/1930 | Laub | 119/153 |
| 2,179,394 | 11/1939 | Wulff | 294/19.1 X |
| 2,499,511 | 3/1950 | Koger | 119/153 |

FOREIGN PATENT DOCUMENTS

| | | | |
|---|---|---|---|
| 295038 | 4/1914 | Fed. Rep. of Germany | 119/153 |
| 2846073 | 4/1980 | Fed. Rep. of Germany . | |
| 290510 | 5/1928 | United Kingdom . | |
| 561190 | 5/1944 | United Kingdom . | |
| 901988 | 7/1962 | United Kingdom . | |

*Primary Examiner*—Sherman D. Basinger

*Attorney, Agent, or Firm*—Fleit, Jacobson, Cohn & Price

[57] ABSTRACT

A rescue device for assisting in removing a person from the water including an elongate rigid member 10 having a curved portion 14 adjacent one end 12 thereof. A flexible strap 20 is connected at the end 12 and to a slider 26 which is slidable along the portion 14. In the position illustrated the loop formed by the strap 20 and the portion 14 are passed over the person in the water and the device is then pulled towards the end 14, so that the slider moves along the portion 14, thereby reducing the circumference of the loop to the length of the strap. Continued movement will then retain the person and pull the person towards the operator.

7 Claims, 3 Drawing Figures

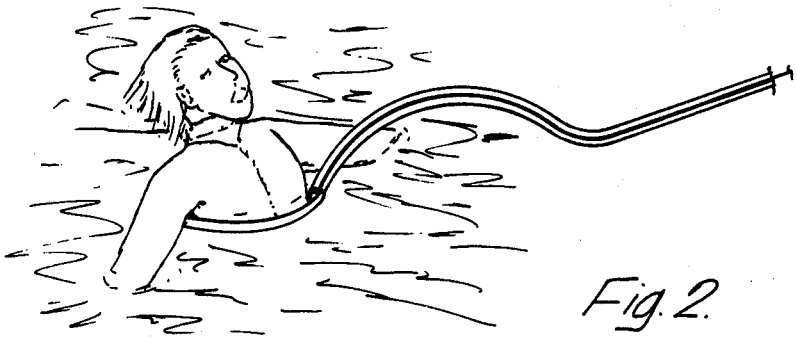
Fig. 2.
Fig. 3.
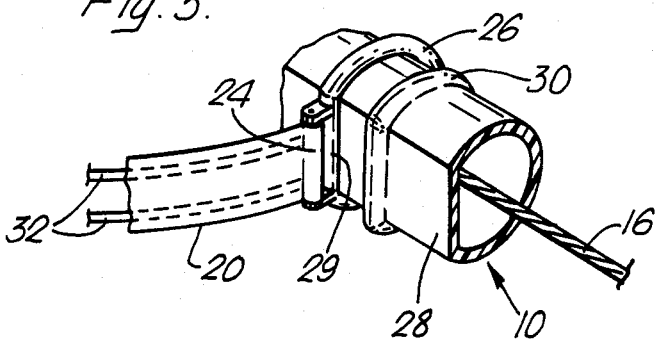

RESCUE DEVICE

SUMMARY OF THE INVENTION

The present invention relates to a rescue device to rescue a person from water. It very often happens in sailing and other boating activities that a person falls overboard and, if the sea or other water is rough, it is quite difficult to rescue the person quickly. Most sailors in fact wear buoyancy aids but it is nonetheless very difficult to bring a boat in rough water closely adjacent to a person who has fallen in the water and thereafter to pull the person into the boat.

It is now proposed, according to the present invention, to provide a rescue device comprising an elongate rigid member, a flexible strap having first and second ends, the first end of the strap being secured to one end of the rigid member and a slider slidable along at least a portion of the member from a position spaced from the one end thereof towards said one end, the second end of the strap being attached to said slider, whereby, with the slider located at said position, the strap and said portion of the rigid member form a loop which can be placed over the body of a person to be rescued from water and the other end of the member can then be pulled, thereby causing the slider to move towards the said one end of the rigid member, to tighten the strap around the person.

With such a construction, one gets as close as reasonably possible to the person to be rescued, and then one can fairly readily manipulate the device so that the loop falls over the person, the loop being sufficiently wide to pass readily over the shoulders. The loop can then be submerged to pass below the level of the person's arms. If one then pulls on the other end of the device the slider will move along the portion of the rigid member to enable the loop to become smaller and thereby firmly hold the person around the chest. Continued pulling will not overtighten the loop particularly if a stop is placed at the one end of the rigid member to prevent the slider moving beyond the end and thence along the strap.

Preferably the portion of the rigid member is made arcuate thereby to give a preformed portion of the loop. Thus, the arcuate portion is part-circular and preferably semi-circular, the strap then forming the other part of a circular loop.

Preferably means are provided releasably to retain the slider at said position to prevent the slider moving along the portion of the rigid member during the act of placing it over the head of the person in the water. This may take many forms and could be a simple catch or it could be a thin line extending to the other end of the rigid member which is held by the rescuer during the time while the loop is passed over the person to be rescued's head.

The strap can take many forms. It could be a simple line or rope and the slider could be a looped portion or eye formed in the end of the rope and passed over the rigid member. In a preferred arrangement, however, the strap is in the form of a flat belt and in order to retain the flat belt so that its flat surface is applied against the body of the person to be rescued, the first end of the belt is preferably secured to the one end of the rigid member to hold the plane of the belt at the first end transverse to the plane of the loop. The rigid member may have such a cross-section and the slider have such a cooperating shape as to guide the slider in a particular orientation, thereby to hold the plane of the belt at the second end transverse to the plane of the loop, thus effectively maintaining the belt in an arcuate vertical orientation as it is placed over the person's head. The strap may in fact be provided with a stiffener to preform it into the shape of the remainder of the loop.

The rigid member may be solid or is preferably in the form of a tube and a line may be attached to the other end of the rigid member for safety reasons and to assist in pulling the person to be rescued in. This line may be passed through the tube and fixed to the first end of the strap.

BRIEF DESCRIPTION OF THE DRAWINGS

In order that the invention may more readily be understood, the following description is given, merely by way of example, reference being made to the accompanying drawings, in which:

FIG. 2 is a schematic view showing the device of FIG. 1 in use; and

FIG. 3 is an enlarged fragmentary cross-sectional view of a portion of the device of FIG. 1.

DETAILED DESCRIPTION

Figure 1:
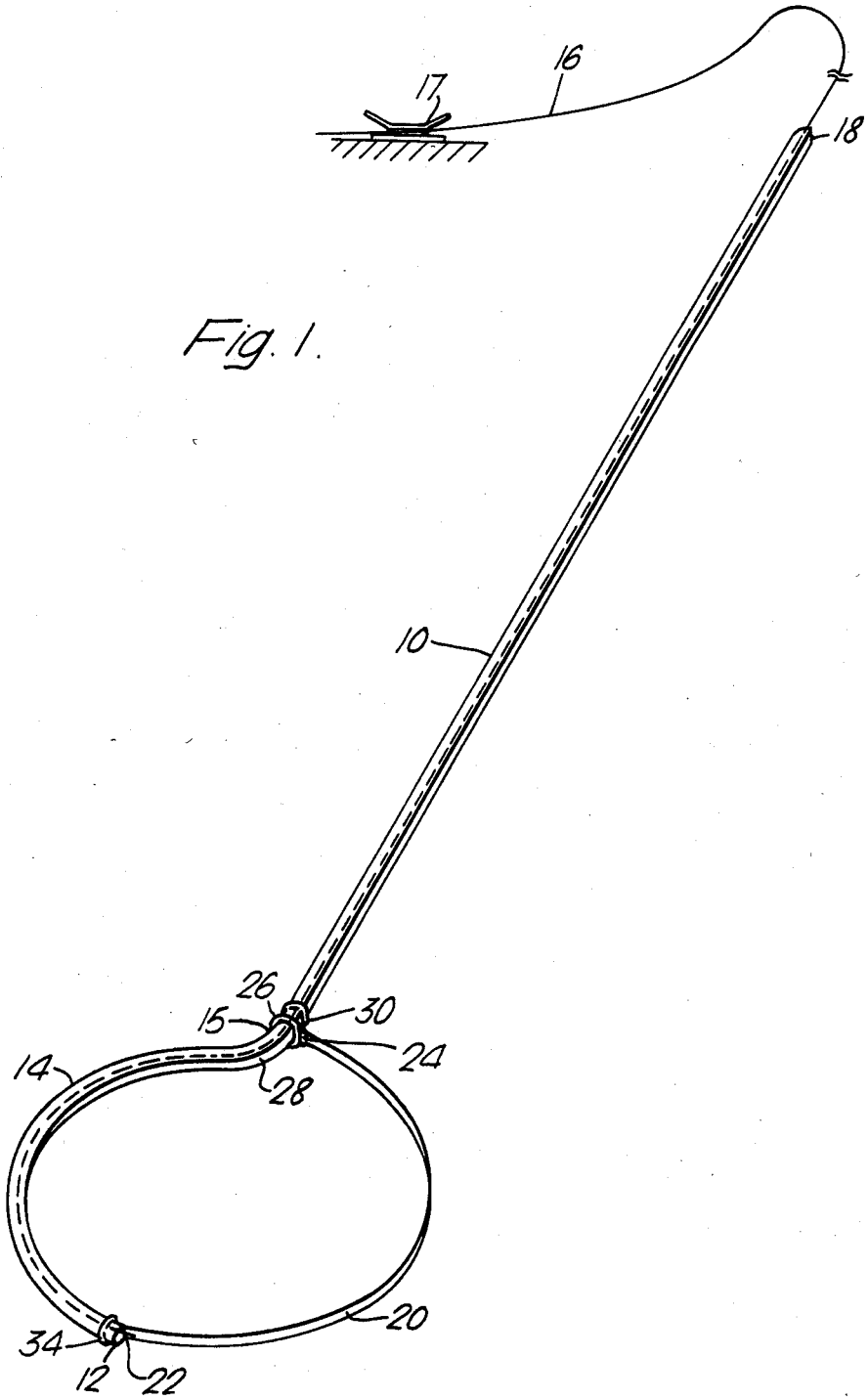
FIG. 1 is a perspective view of one embodiment of rescue device according to the invention.

Referring first to FIG. 1, there is illustrated therein a rigid member in the form of an elongate tube 10 having adjacent one end 12 an arcuate portion 14 which is of generally semi-circular shape. A line 16 passes from said one end 12 through the tube and out of the other end 18 where it may, for example, be secured to a cleat 17.

Fixed to the one end 12 is a strap in the form of a belt 20, one end of which is secured to the line 16 adjacent the end 12, or to some other means adjacent the end 12, preferably to retain the strap in a vertical plane, as seen in FIG. 1, adjacent the end 12. The other end 24 of the strap 20 is secured to a slider 26. The tube 10 is provided with a flattened section 28 which can be seen more clearly in FIG. 3 and the slider 26 is provided with a straight portion 29 overlying the flattened portion 28 thereby to prevent the slider from rotating about the axis of the tube 10. A combined stop and retainer 30 is mounted on the exterior of the tube 10 adjacent a position 15 of the tube at the end of the arcuate portion 14. This will retain the slider 26 in the position illustrated in FIG. 1 so that the strap, in effect, completes the circle formed in part by the semi-circular arcuate portion 14. Preferably the strap or belt 20 is provided with stiffeners 32 to preform the belt to the upper half of the circle as illustrated in FIG. 1. At the end 12 of the tube 10, there is a stop 34 to prevent the slider going beyond the end.

In use of the above device, when a person has, for example, fallen overboard from a boat, a person on board the boat grasps the tube 10 adjacent the end 14, the line 16 having previously been secured e.g. by the cleat 17. The loop formed by the strap 20 and the arcuate portion 14 is then placed over the head of the person in the water, the loop being sufficiently large, for example, of the order of 1 meter in diameter, to pass easily over the head and shoulders of the person to be rescued. If the device is then pushed downwardly so that the portion 14 and strap 20 go below the arms of the person in the water, it can then be pulled at the end 14 so that the traveller will move along the portion 14 until it arrives at the end 12. The stop 34 then prevents the traveller moving there-beyond. The loop will then become very much smaller and will have approximately half its original circumference. If one continues to pull then the person will be retained and can be pulled towards the boat and then pulled inboard fairly readily.

The retaining means 30 can take several forms. For example it could simply be a latch, or a thickened portion which engages under the straight part 29, or it could be in the form of an external light cord which could be controlled by the user.

I claim:

1. A rescue device comprising:

an elongate rigid member having one end and an opposite end, said rigid member including a generally straight elongate portion extending from said opposite end and a substantially semi-circular arcuate portion connected to the end of said straight portion remote from said opposite end, said substantially semi-circular arcuate portion extending to said one end;

a flexible strap having first and second ends, the first end of the strap being secured to said one end of the rigid member;

a slider slidable along said substantially semi-circular annular portion of said rigid member, from a position adjacent the junction of said semi-circular arcuate portion and said generally straight portion of said rigid member, said slider being slidable towards said one end;

a stop at said one end effective to prevent said slider from sliding beyond said one end, the second end of the strap being attached to said slider; and means to releasably retain the slider at said position, and with the slider located at said position, the strap and said semi-circular arcuate portion of the rigid member together form a substantially circular loop which can be placed over the body of a person to be rescued from water, and the opposite end of the member can then be pulled, thereby causing the slider to move towards said one end of the rigid member, effective to tighten the strap around a person.

2. A rescue device according to claim 1, wherein the strap is in the form of a flat belt, the first end of which is secured to the one end of the rigid member to hold the plane of the belt at the first end transverse to the plane of the loop.

3. A rescue device according to claim 2, wherein said portion of the rigid member has such a cross-section and the slider has such a cooperating shape as to guide the slider in a particular orientation, thereby to hold the plane of the belt at the second end transverse to the plane of the loop.

4. A rescue device according to claim 1, wherein the strap is lightly stiffened to preform it to the shape of the remainder of the loop.

5. A rescue device according to claim 1, and further comprising a line extending from the other end of the rigid member.

6. A rescue device according to claim 5, wherein the rigid member is in the form of a tube.

7. A rescue device according to claim 6, wherein the line passes through the tube and is fixed to the first end of the strap.

* * * * *